US010082755B1

(12) United States Patent
Takahashi

(10) Patent No.: US 10,082,755 B1
(45) Date of Patent: Sep. 25, 2018

(54) FIXING DEVICE AND IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Kazutoshi Takahashi, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/467,127

(22) Filed: Mar. 23, 2017

(51) Int. Cl.
*G03G 15/20* (2006.01)

(52) U.S. Cl.
CPC ..... *G03G 15/2089* (2013.01)

(58) Field of Classification Search
CPC ..... G03G 15/2032; G03G 15/2067; G03G 15/2035; G03G 15/2071
See application file for complete search history.

(56) References Cited

U.S. PATENT DOCUMENTS 8,295,751 B2 10/2012 Souda et al.
9,452,629 B1 9/2016 Ishii
2011/0097093 A1* 4/2011 Birumachi ..... G03G 15/2064 399/21
2011/0318040 A1* 12/2011 Kanno ..... G03G 15/2039 399/69
2012/0237229 A1* 9/2012 Okamoto ..... G03G 15/2032 399/33
2013/0071153 A1* 3/2013 Oomoto ..... G03G 15/2032 399/329
2013/0084088 A1* 4/2013 Sakai ..... G03G 15/2064 399/45
2013/0272756 A1* 10/2013 Nagata ..... G03G 15/2085 399/323
2016/0320731 A1* 11/2016 Kitagawa ..... G03G 15/2032
2017/0205743 A1* 7/2017 Kamiya ..... G03G 15/2053

* cited by examiner

*Primary Examiner* — Sevan A Aydin
(74) *Attorney, Agent, or Firm* — Amin, Turocy & Watson LLP

(57) ABSTRACT

A fixing device according to an embodiment includes a first rotating body, a pressing unit, and an urging member. The pressing unit includes a belt, a second rotating body, a belt supporting member, and a pushing member. The pushing member includes a pressing region for pressing the belt toward the first rotating body. The pushing member is disposed between the second rotating body and the belt supporting member. The pressing unit is capable of switching a pressing position and a release position. When viewed from the axial direction of the first rotating body, a line connecting the center of the first rotating body and the center of the turning fulcrum passes the pressing region of the pushing member in both of the pressing position and the release position.

18 Claims, 8 Drawing Sheets

FIXING DEVICE AND IMAGE FORMING APPARATUS

FIELD

Embodiments described herein relate generally to a fixing device, an image forming apparatus, and methods associated therewith.

BACKGROUND

A fixing device includes a heating roller and a pressing unit. The pressing unit includes a pressurizing belt and a pressurizing roller. The pressing unit presses a recording medium such as a sheet against the heating roller to thereby thermally fix toner to the recording medium. The fixing device sometimes weakens the pressing force applied by the pressing unit in order to prevent creases from occurring in the recording medium.

If the fixing device weakens the pressing force applied by the pressing unit, pressing of the heating roller by the pressurizing belt becomes insufficient. Therefore, in the fixing device, in some cases, the pressurizing belt does not follow the heating roller and as a result the recording medium is less easily conveyed.

DETAILED DESCRIPTION

In general, according to one embodiment, a fixing device includes a first rotating body, a pressing unit, and an urging member. The first rotating body is heated by a heat source. The pressing unit includes a belt, a second rotating body, a belt supporting member, and a pushing member. The belt is opposed to the outer circumferential surface of the first rotating body. The belt is wound around the outer circumferential surface of the second rotating body. The belt is wound around the outer circumferential surface of the belt supporting member. The pushing member includes a pressing region for pressing the belt toward the first rotating body. The pushing member is disposed between the second rotating body and the belt supporting member. The pressing unit is capable of switching a pressing position and a release position. In the pressing position, the pressing unit turns around a turning fulcrum present in a position away from the first rotating body to thereby press the belt against the first rotating body with the second rotating body. In the release position, the pressing unit releases the pressing by the second rotating body. When viewed from the axial direction of the first rotating body, a line connecting the center of the first rotating body and the center of the turning fulcrum passes the pressing region of the pushing member in both of the pressing position and the release position. The urging member urges the pressing unit in a first direction in which the second rotating body approaches the first rotating body.

A fixing device and an image forming apparatus in an embodiment are explained below with reference to the drawings.

Figure 1:
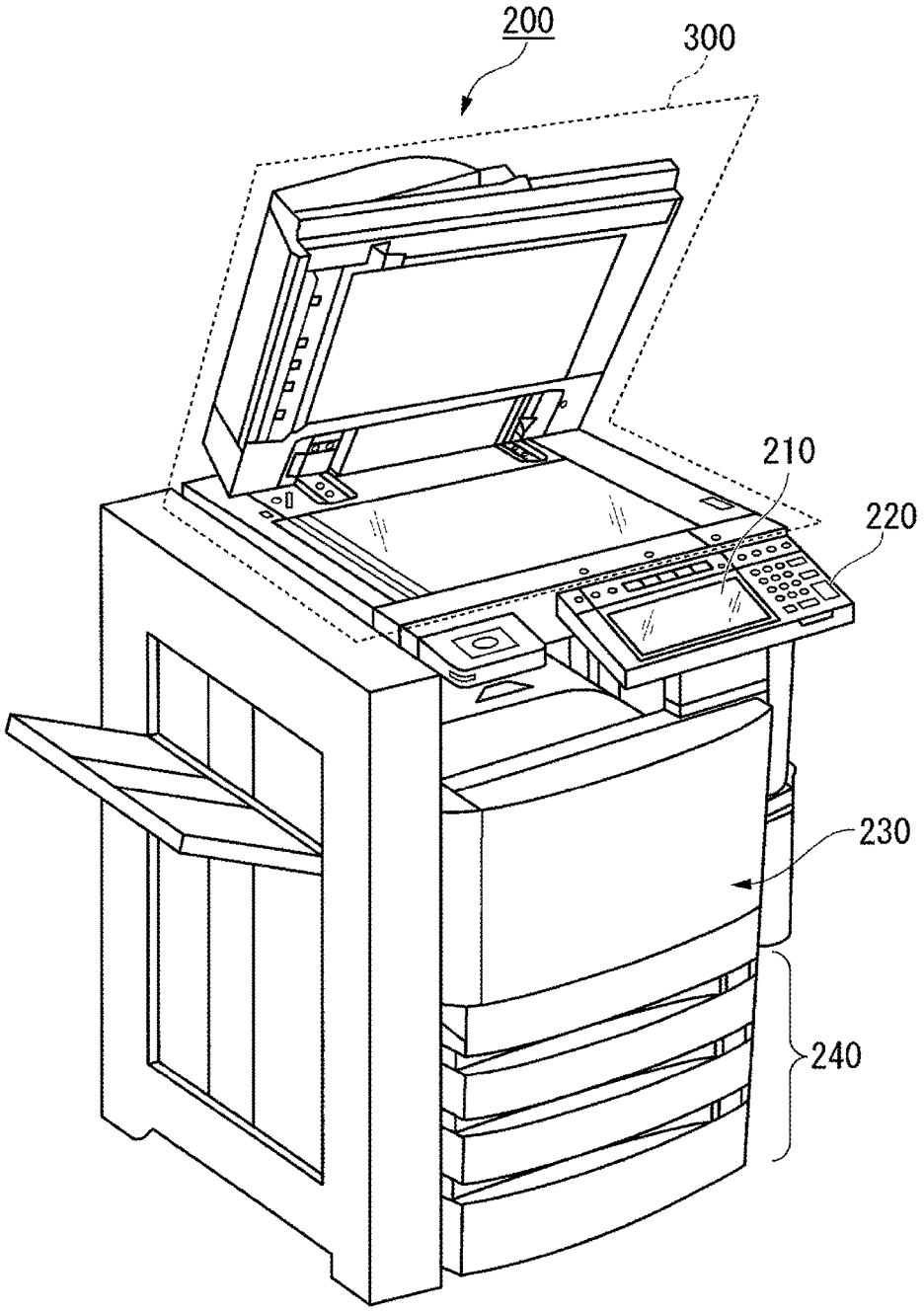
FIG. 1 is an exterior view showing an image forming apparatus in an embodiment.

FIG. 1 is an exterior view showing an overall configuration example of an image forming apparatus 200 in the embodiment. For example, the image forming apparatus 200 is a multifunction peripheral. The image forming apparatus 200 includes a display 210, a control panel 220, a printer section 230, a sheet storing section 240, and an image reading section 300.

The image forming apparatus 200 forms an image on a recording medium such as a sheet using a developer such as toner. For example, the sheet is paper or label paper. The sheet is not particularly limited as long as the image forming apparatus 200 can form an image on the surface of the sheet. The recording medium is not limited to a single sheet and may have a structure in which a plurality of sheets are laid one on top of another and at least parts of the sheets are bonded and fixed like an envelope. The recording medium (the envelope, etc.) having the structure in which the plurality of sheets are laid one on top of another and at least parts of the sheets are bonded and fixed is referred to as "stacked recording medium".

The display 210 is an image display device such as a liquid crystal display or an organic EL (Electro Luminescence) display. The display 210 displays various kinds of information concerning the image forming apparatus 200.

The control panel 220 includes a plurality of buttons. The control panel 220 receives operation by a user. The control panel 220 outputs a signal corresponding to the operation performed by the user to a control section of the image forming apparatus 200. Note that the display 210 and the control panel 220 may be configured as an integral touch panel.

The printer section 230 forms an image on the sheet on the basis of image information generated by the image reading section 300 or image information received via a communication path. For example, the printer section 230 forms an image according to processing explained below. An image forming section of the printer section 230 forms an electrostatic latent image on a photosensitive drum on the basis of the image information. The image forming section of the printer section 230 forms a visible image by causing a developer to adhere to the electrostatic latent image. Toner is a specific example of the developer. A transfer section of the printer section 230 transfers the visible image onto the sheet. A fixing section of the printer section 230 performs heating and pressurizing on the sheet to thereby fix the visible image on the sheet. Note that the sheet on which the image is formed may be a sheet stored in the sheet storing section 240 or may be a manually fed sheet.

The sheet storing section 240 stores sheets used for the image formation in the printer section 230.

The image reading section 300 reads reading target image information as contrast of light. The image reading section 300 records the read image information. The recorded image information may be transmitted to other image processing apparatuses via a network. The recorded image information may be formed as an image on the sheet by the printer section 230.

Figure 2:
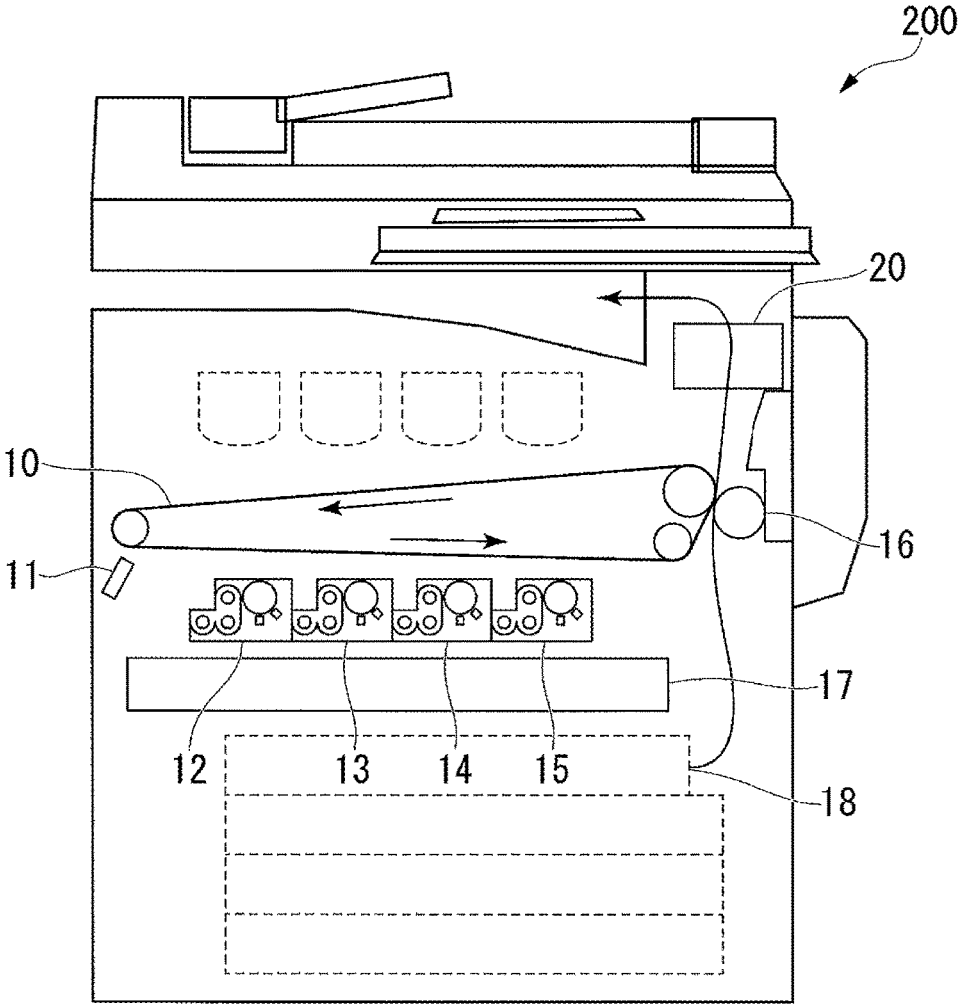
FIG. 2 is a diagram showing a schematic configuration of the image forming apparatus.

FIG. 2 is a diagram showing an example of a schematic configuration of the image forming apparatus 200. The image forming apparatus 200 shown in FIG. 2 is an image forming apparatus of an electrophotographic system. The image forming apparatus 200 includes an intermediate transfer body 10, a blade 11 (a toner removing section), image forming sections 12 to 15, a secondary transfer roller 16, a control section 17, a paper feeding section 18, and a fixing device 20.

The intermediate transfer body 10 is an endless belt. The intermediate transfer body 10 rotates in a direction of an arrow shown in FIG. 2.

The blade 11 removes excess toner adhering on the intermediate transfer body 10.

The image forming sections 12 to 15 form images on the intermediate transfer body 10 using toners of respective colors (in the example shown in FIG. 2, four colors).

The secondary transfer roller 16 transfers the images by the toners formed on the intermediate transfer body 10 onto the sheet.

The control section 17 controls the image forming sections 12 to 15 and the fixing device 20.

The paper feeding section 18 feeds the sheet.

The fixing device 20 heats and pressurizes the images by the toners transferred onto the sheet to fix the images on the sheet.

The image forming apparatus 200 converts image data to be formed into image data of the colors through image processing. For example, the image forming apparatus 200 converts the image data into image data of colors of yellow (Y), magenta (M), cyan (C), and black (K).

The image forming apparatus 200 executes a first transfer process and a second transfer process. In the first transfer process, the image forming sections 12 to 15 multiply transfer the images by the toners of the colors onto the intermediate transfer body 10 to lay the images one on top of another. In the second transfer process, the secondary transfer roller 16 collectively transfers the images by the toners on the intermediate transfer body 10 onto the sheet. The sheet is delivered from the paper feeding section 18 and conveyed through a sheet conveyance path. The sheet passes through the secondary transfer roller 16 and the fixing device 20 and is discharged to a paper discharge tray.

Figure 3:
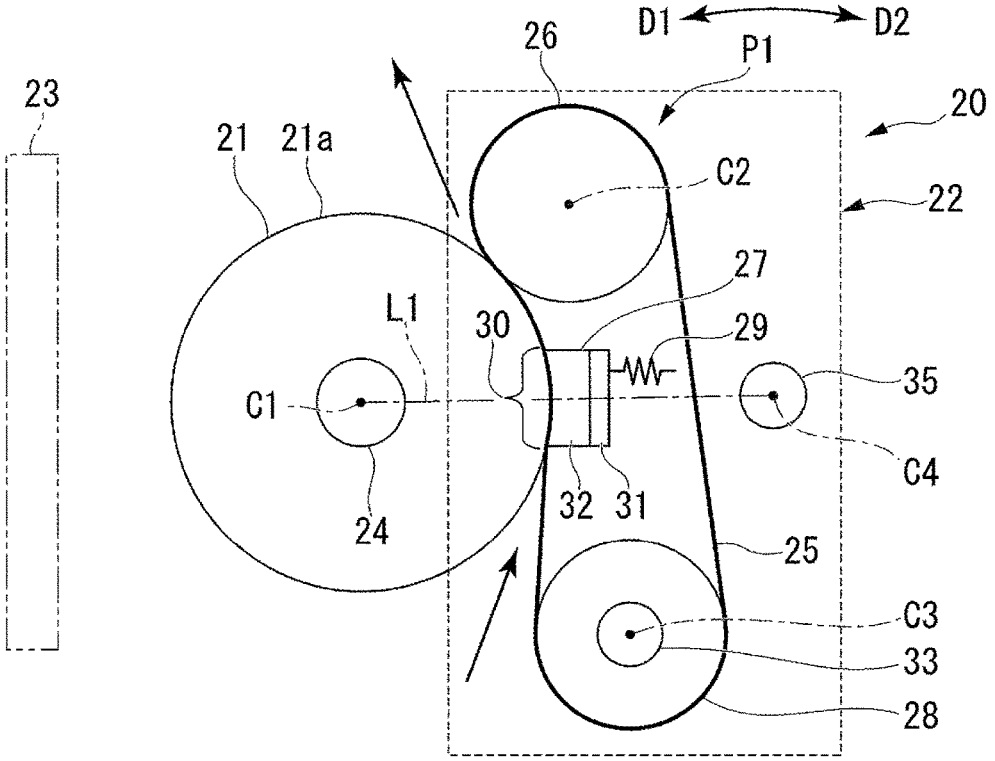
FIG. 3 is a diagram showing a schematic configuration of a fixing device in the embodiment.
Figure 4:
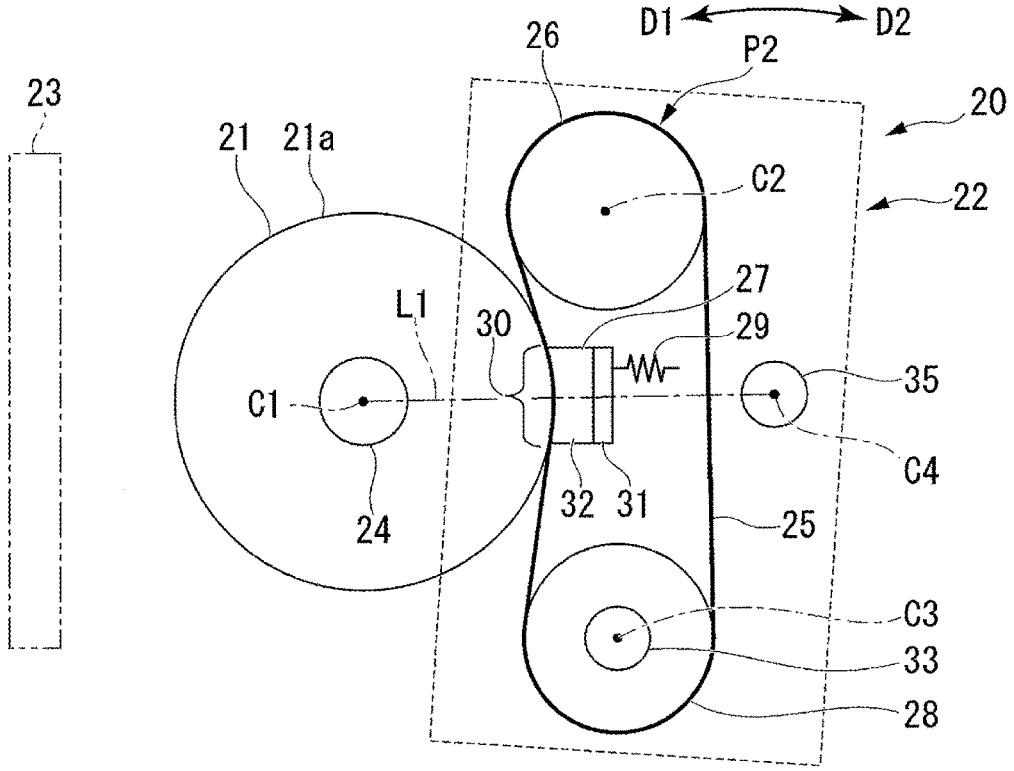
FIG. 4 is a diagram showing the schematic configuration of the fixing device.

FIGS. 3 and 4 are diagrams showing a schematic configuration of the fixing device 20 shown in FIG. 2.

As shown in FIG. 3, the fixing device 20 includes a heat roller 21 (a first rotating body), a pressing unit 22, and an urging member 23.

The heat roller 21 is a cylinder body made of metal such as aluminum or iron. The outer circumferential surface of the heat roller 21 is covered with a release layer. For example, the release layer is made of fluorocarbon resin, silicon rubber, or the like. The heat roller 21 incorporates a lamp 24 (a heat source). The heat roller 21 is heated by the lamp 24. For example, the lamp 24 is a halogen lamp, an IH heater, or the like.

The pressing unit 22 includes a pressurizing belt 25, a pressurizing roller 26 (a second rotating body), a pressurizing pad 27 (a pushing member), and a pressurizing belt heat roller 28 (a belt supporting member).

The pressurizing belt 25 is an endless belt. The pressurizing belt 25 is wound around the outer circumferential surface of the pressurizing roller 26 and the outer circumferential surface of the pressurizing belt heat roller 28. The pressurizing belt 25 rotates following the heat roller 21. The pressurizing belt 25 is opposed to an outer circumferential surface 21*a* of the heat roller 21. The pressurizing belt 25 is brought into pressurized contact with the heat roller 21 by the pressurizing roller 26 and the pressurizing pad 27. A fixing nip section is formed between the pressurizing belt 25 and the heat roller 21 by the pressurized contact.

The pressurizing roller 26 is a cylinder body made of metal such as stainless steel. For example, the outer circumferential surface of the pressurizing roller 26 is covered with a rubber layer. The pressurizing roller 26 presses the pressurizing belt 25 toward the heat roller 21. A center axis C2 of the pressurizing roller 26 is parallel to a center axis C1 of the heat roller 21. The pressurizing roller 26 brings the pressurizing belt 25 into pressurized contact with the heat roller 21. An exit of the fixing nip section is formed by the pressurizing roller 26.

The pressurizing pad 27 is present upstream in a conveying direction of the sheet compared with the pressurizing roller 26 and downstream in the conveying direction of the sheet compared with the pressurizing belt heat roller 28. Therefore, the pressurizing pad 27 is disposed between the pressurizing roller 26 and the pressurizing belt heat roller 28 with respect to the conveying direction of the sheet. The pressurizing pad 27 includes a pedestal 31, a pad body 32, and a pressurizing mechanism 29. The pad body 32 is made of a soft material such as silicon rubber. The pad body 32 is provided on one surface of the pedestal 31. The pressurizing pad 27 presses the pressurizing belt 25 with the pad body 32. A slip sheet for a reduction of friction may be provided between the pressurizing pad 27 and the pressurizing belt 25. The pressurizing mechanism 29 urges the pressurizing pad 27 toward the heat roller 21. For example, the pressurizing mechanism 29 is a coil spring.

The pressurizing pad 27 includes a pressing region 30. The pressing region 30 is a partial region of the pad body 32. For example, the pressing region 30 is a cylindrical surface formed along the outer circumferential surface 21*a* of the heat roller 21. The pressing region 30 is opposed to the outer circumferential surface 21*a* of the heat roller 21 via the pressurizing belt 25. The pressing region 30 is in contact with the outer circumferential surface 21*a* of the heat roller 21 via the pressurizing belt 25. The pressing region 30 presses the pressurizing belt 25 toward the outer circumferential surface 21*a* of the heat roller 21.

The pressurizing belt heat roller 28 is a cylinder body made of metal such as aluminum or iron. The outer circumferential surface of the pressurizing belt heat roller 28 is covered with a release layer. The release layer is made of fluorocarbon resin, silicon rubber, or the like. The pressurizing belt heat roller 28 incorporates a lamp 33 (a heat source). The pressurizing belt heat roller 28 is heated by the lamp 33. For example, the lamp 33 is a halogen lamp, an IH heater, or the like. The pressurizing belt heat roller 28 heats the pressurizing belt 25. A center axis C3 of the pressurizing belt heat roller 28 is parallel to the center axis C1 of the heat roller 21. The pressurizing belt heat roller 28 is disposed upstream in the conveying direction of the sheet compared with the pressurizing pad 27.

The pressurizing belt heat roller 28 may be movable in directions in which the pressurizing belt heat roller 28 approaches and separates from the pressurizing roller 26. Consequently, it is possible to easily adjust the tension of the pressurizing belt 25.

The pressing unit 22 is capable of turning around a turning fulcrum 35. The turning fulcrum 35 is present in a position away from the heat roller 21. A center axis C4 of the turning fulcrum 35 is parallel to the center axis C1 of the heat roller 21.

A first direction D1 is a direction in the axial circumferential direction of the turning fulcrum 35. The first direction D1 is a direction in which the pressurizing roller 26 approaches the heat roller 21. A second direction D2 is a direction opposite to the first direction D1 in the axial circumferential direction of the turning fulcrum 35. The second direction D2 is a direction in which the pressurizing roller 26 separates from the heat roller 21.

The pressing unit 22 is capable of switching a pressing position P1 shown in FIG. 3 and a release position P2 shown in FIG. 4 according to the turning around the turning fulcrum 35. The pressing position P1 is a position where the pressurizing belt 25 is pressed against the heat roller 21 by the pressurizing roller 26. The release position P2 is a position where the pressing by the pressurizing roller 26 is released. In the release position P2, the pressurizing roller 26 may be in contact with the heat roller 21 via the pressurizing belt 25 or may be separated from the heat roller 21.

The urging member 23 urges the pressing unit 22 in the first direction D1. For example, the urging member 23 is a coil spring. The urging member 23 urges the pressurizing roller 26 in the first direction D1.

When viewed from a direction parallel to the center axis C1 of the heat roller 21, an imaginary line L1 is a line connecting the center axis C1 of the heat roller 21 and the center axis C4 of the turning fulcrum 35.

When viewed from the direction parallel to the center axis C1 of the heat roller 21, the imaginary line L1 passes the pressing region 30 of the pressurizing pad 27 if the pressing unit 22 is present in the pressing position P1 shown in FIG. 3. When viewed from the direction parallel to the center axis C1 of the heat roller 21, the imaginary line L1 also passes the pressing region 30 of the pressing pad 27 if the pressing unit 22 is present in the release position P2 shown in FIG. 4.

The imaginary line L1 only has to pass apart of the pressing region 30 in the pressing position P1 and the release position P2. A position where the imaginary line L1 passes the pressing region 30 is not particularly limited. For example, the position where the imaginary line L1 passes the pressing region 30 may be the center in the sheet conveying direction or may be an end portion of the sheet conveying direction.

When viewed from the direction parallel to the center axis C1 of the heat roller 21, the imaginary line L1 crosses the pressing region 30. In other words, the pressing region 30 is present in a position striding across the imaginary line L1. When viewed from the direction parallel to the center axis C1 of the heat roller 21, the center axis C4 is present within a projection range of projection from the center axis C1 toward the pressing region 30.

As shown in FIG. 3, the fixing device 20 allows the sheet, on which an image by unfixed toner (an unfixed developer image) is transferred, to pass in an arrow direction in the figure. The sheet and the image by the toner on the sheet pass through a nip between the heat roller 21 and the pressurizing belt 25 to be heated and pressurized. The sheet passing through the nip is heated by the heat roller 21 and the pressurizing belt 25. The image by the toner is fixed on the sheet.

In the fixing device 20, wherever the pressing unit 22 is present in the pressing position P1 (see FIG. 3) or the release position P2 (see FIG. 4), the imaginary line L1 connecting the center of the heat roller 21 and the center of the turning fulcrum 35 passes the pressing region 30 of the pressurizing pad 27. Therefore, displacement of the pressurizing pad 27 (a change in the distance between the heat roller 21 and the pressurizing pad 27) decreases between the pressing position P1 and the release position P2. Therefore, even if the pressing unit 22 is present in the release position P2, compared with the case where the pressing unit 22 is present in the pressing position P1, a pressing force of the pressing pad 27 against the heat roller 21 does not greatly decrease.

Unlike plain paper (a single sheet), if an image is fixed on the stacked recording medium (the envelope, etc.), if the pressing unit 22 is present in the pressing position P1 (see FIG. 3), creases easily occur in the stacked recording medium because the stacked recording medium is bent. Therefore, the pressing unit 22 is set in the release position P2 (see FIG. 4). Consequently, since a pressing force by the pressurizing roller 26 decreases and the bend of the stacked recording medium decreases, the occurrence of creases is suppressed. In this case, the stacked recording medium is pressed mainly by the pressurizing pad 27 without being pressed by the pressurizing roller 26. Therefore, conveying speed of the stacked recording medium is reduced. Consequently, the toner is fixed on the stacked recording medium.

With the fixing device 20, since the pressing force of the pressurizing pad 27 does not decrease even if the pressing unit 22 is present in the release position P2, the pressurizing belt 25 rotates following the heat roller 21. Therefore, the conveyance of the recording medium (the stacked recording medium) such as the sheet is not hindered.

A fixing device 120, which is a specific example of the fixing device 20, is explained with reference to FIGS. 5 to 9.

Figure 5:
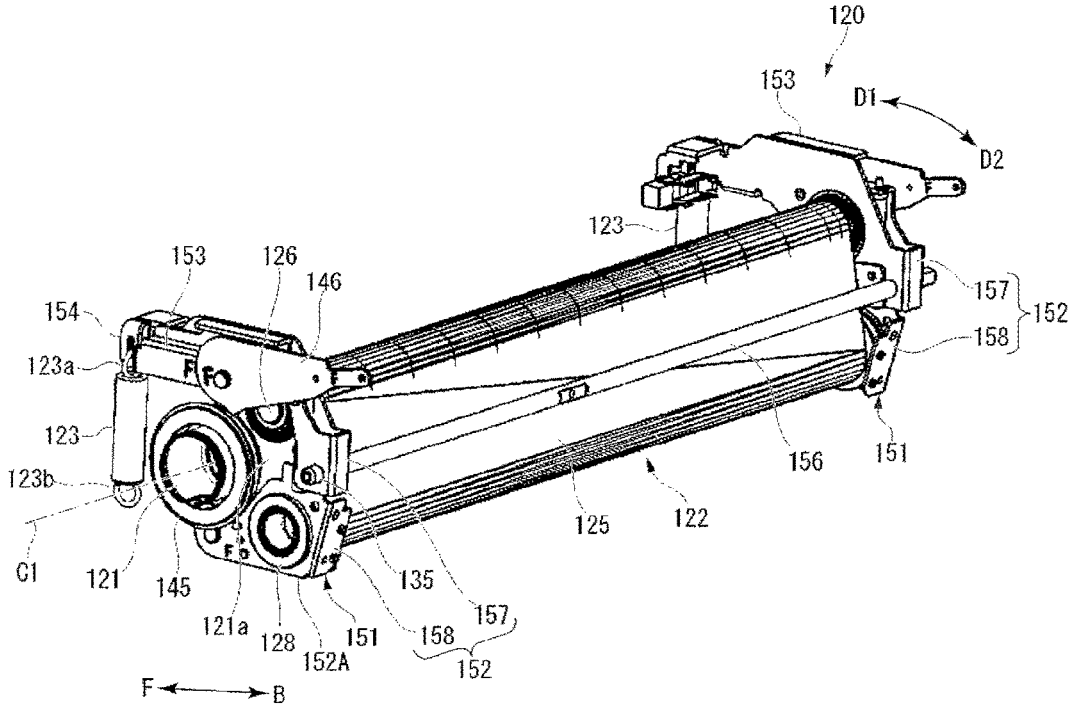
FIG. 5 is a perspective view showing the fixing device.
Figure 6:
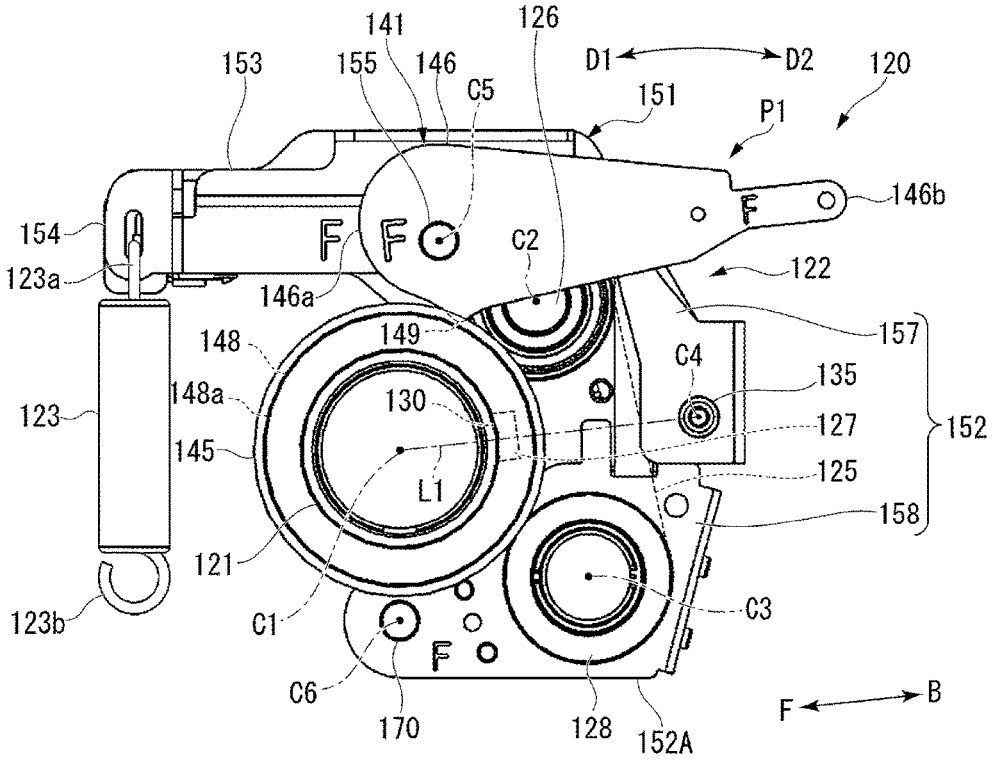
FIG. 6 is a front view showing the fixing device.
Figure 7:
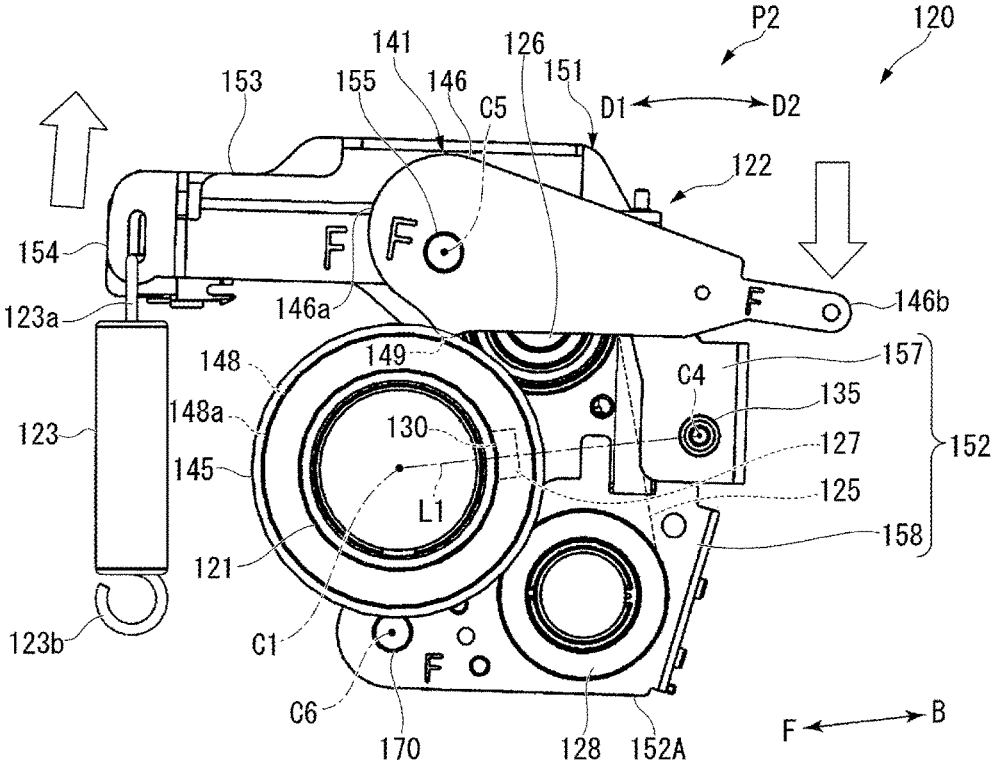
FIG. 7 is a front view showing the fixing device.
Figure 8:
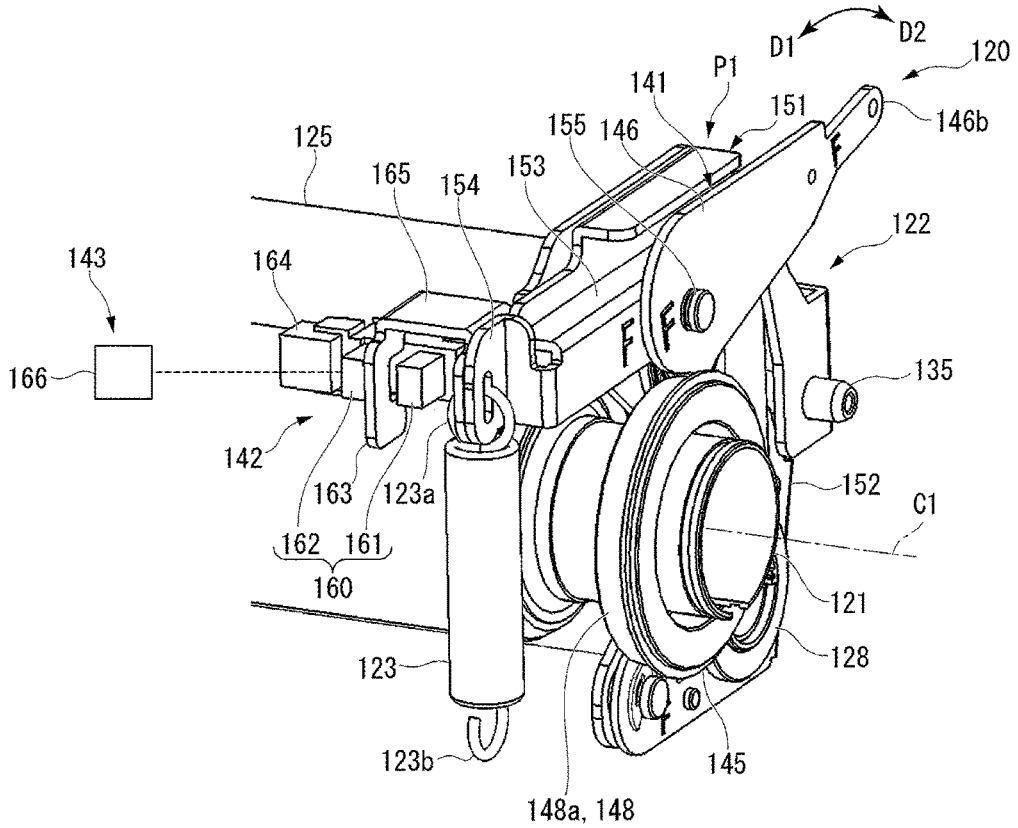
FIG. 8 is a perspective view showing a part of the fixing device.
Figure 9:
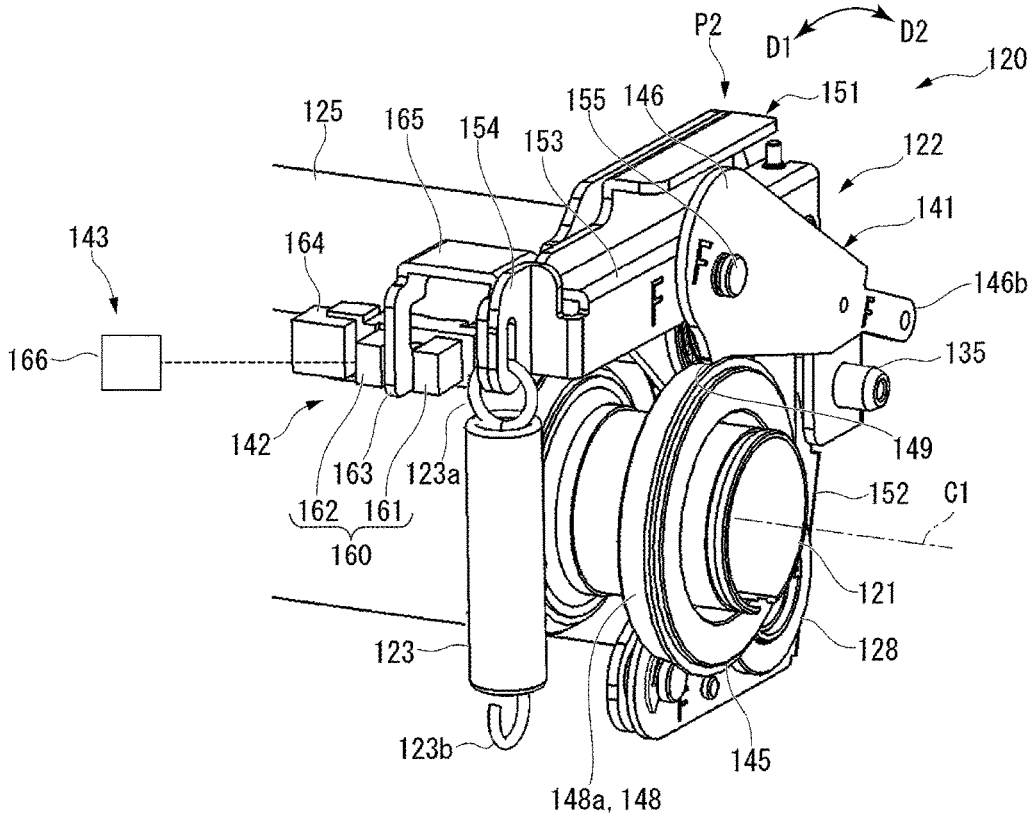
FIG. 9 is a perspective view showing a part of the fixing device.

FIG. 5 is a perspective view showing the fixing device in the embodiment. FIG. 6 is a front view showing the fixing device. FIG. 7 is a front view showing the fixing device. FIG. 8 is a perspective view showing a part of the fixing device. FIG. 9 is a perspective view showing a part of the fixing device.

As shown in FIG. 6, a line connecting a center axis C1 of a heat roller 121 and a center axis C4 of a first turning fulcrum 135 is represented as L1. A direction from the first turning fulcrum 135 to a heat roller 121 along the imaginary line L1 is referred to as forward direction F and the opposite direction of the direction is referred to as backward direction B.

As shown in FIG. 5, the fixing device 120 includes the heat roller 121 (a first turning body), a pressing unit 122, an urging member 123, a moving mechanism 141 (see FIG. 6), a detecting mechanism 142 (see FIG. 8), and a stopping mechanism 143 (see FIG. 8).

The heat roller 121 has a configuration same as the configuration of the heat roller 21 shown in FIG. 3.

The pressing unit 122 includes a pressurizing belt 125, a pressurizing roller 126 (a second rotating body), a pressurizing pad 127 (a pushing member) (see FIG. 6), a pressurizing belt heat roller 128 (a belt supporting member), a pair of supporting frames 151, and a coupling 156 (see FIG. 6).

The pressurizing belt 125 has the same configuration as the configuration of the pressurizing belt 25 shown in FIG. 3. The pressurizing belt 125 is opposed to an outer circumferential surface 121*a* of the heat roller 121.

The pressurizing roller 126 has the same configuration as the configuration of the pressurizing roller 26 shown in FIG. 3.

The pressurizing pad 127 has a configuration same as the configuration of the pressurizing pad 27 shown in FIG. 3. Reference numeral 130 denotes a pressing region of the pressurizing pad 127. The pressing region 130 is opposed to the heat roller 121 via the pressurizing belt 125. The pressurizing region 130 presses the pressurizing belt 125 toward the heat roller 121.

The pressurizing belt heat roller 128 has a configuration same as the configuration of the pressurizing belt heat roller 28 shown in FIG. 3.

The supporting frame 151 includes a main body section 152 and a pressurizing arm 153.

The main body section 152 includes an upper frame 157 and a lower frame 158. The upper frame 157 and the lower frame 158 are coupled to each other. For example, the upper frame 157 supports the pressurizing roller 126 and the pressurizing pad 127. For example, the lower frame 158 supports the pressurizing belt heat roller 128. Consequently, the pair of supporting frames 151 supports both end portions of the pressurizing roller 126 and both end portions of the pressurizing belt heat roller 128.

In the main body section 152, a portion that supports the pressurizing roller 126 and the pressurizing belt heat roller 128 is referred to as main section 152A.

The pressurizing arm 153 extends generally toward the forward direction F from the main section 152A. One end portion 123*a* of the urging member 123 is coupled to a distal end portion 154 of the pressurizing arm 153.

The coupling 156 is laid over between the pair of supporting frames 151. The coupling 156 couples the pair of supporting frames 151 to each other.

As shown in FIG. 6, the pressing unit 122 is capable of turning around the first turning fulcrum 135 provided in the main body section 152 of the supporting frame 151. The first turning fulcrum 135 is present in a position away from the heat roller 121.

The first direction D1 is a direction in which the pressurizing roller 126 approaches the heat roller 121 in the axial circumferential direction of the first turning fulcrum 135. The second direction D2 is a direction in which the pressurizing roller 126 separates from the heat roller 121 in the axial circumferential direction of the first turning fulcrum 135.

The pressing unit 122 is capable of switching the pressing position P1 shown in FIG. 6 and the release position P2 shown in FIG. 7 according to the turning around the first turning fulcrum 135.

The pressing position P1 shown in FIG. 6 is a position where the pressurizing belt 125 is pressed against the heat roller 121 by the pressurizing roller 126.

The release position P2 shown in FIG. 7 is a position where the pressing by the pressurizing roller 126 is released. L1 shown in FIGS. 6 and 7 is a line connecting the center axis C1 of the heat roller 121 and the center axis C4 of the first turning fulcrum 135 when viewed from a direction parallel to the center axis C1 of the heat roller 121.

When viewed from the direction parallel to the center axis C1 of the heat roller 121, the imaginary line L1 passes the pressing region 130 of the pressurizing pad 127 if the pressing unit 122 is present in the pressing position P1 shown in FIG. 6. When viewed from the direction parallel to the center axis C1 of the heat roller 121, the imaginary line L1 also passes the pressing region 130 of the pressurizing pad 127 if the pressing unit 122 is present in the release position P2 shown in FIG. 7.

The urging member 123 urges the pressing unit 122 in the first direction D1. For example, the urging member 123 is a coil spring. One end portion 123*a* of the urging member 123 is coupled to the distal end portion 154 of the pressurizing arm 153. The other end portion 123*b* is fixed to a not-shown fixed point.

The moving mechanism 141 includes a roller holding member 145 (a first rotating-body holding member) and a separating arm 146.

The roller holding member 145 is an annular ball bearing. The annular ball bearing includes an inner ring (not shown in the figure) and an outer ring 148. The roller holding member 145 is provided in the outer circumference of an end portion of the heat roller 121. The roller holding member 145 is capable of rotating together with the heat roller 121.

An outer circumferential surface 148*a* of the outer ring 148 is a circumferential surface, the center axis of which coincides with the center axis C1 of the heat roller 121. The outer circumferential surface 148*a* of the outer ring 148 is formed to be smooth by polishing. The outer circumferential surface 148*a* is subjected to heat treatment and has high hardness. Therefore, the outer circumferential surface 148*a* less easily wears.

The separating arm 146 is formed in a long plate shape. The thickness direction of the separating arm 146 is parallel to the center axis C1 of the heat roller 121.

A contact convex section 149 (a contact part) (see FIG. 6) projecting in a side direction (the width direction of the separating arm 146) is formed in a part of a side edge of the separating arm 146. The contact convex section 149 is capable of coming into contact with the outer circumferential surface 148*a* of the roller holding member 145.

The separating arm 146 is supported by a second turning fulcrum 155 provided in the supporting frame 151. The second turning fulcrum 155 is present in a position close to one end portion 146*a* of the separating arm 146. A center axis C5 of the second turning fulcrum 155 is parallel to the center axis C1 of the heat roller 121. The separating arm 146 is capable of turning around the center axis C5 of the second turning fulcrum 155 with respect to the supporting frame 151. In the separating arm 146, the distance from the second turning fulcrum 155 to the other end portion 146*b* is sufficiently long compared with the distance from the second turning fulcrum 155 to the contact convex section 149.

As shown in FIGS. 8 and 9, the detecting mechanism 142 detects that the pressing unit 122 is present in the release position P2.

The detecting mechanism 142 includes a detection sensor 160, a light blocking plate 163, and a control section 164. The detection sensor 160 is an optical sensor including a light source 161 and a light receiving section 162. For example, the light source 161 is a laser light source. For example, the light receiving section 162 is a photodiode. The light source 161 and the light receiving section 162 are attached to a not-shown fixed frame. The light source 161 and the light receiving section 162 are provided side by side in a direction extending along the center axis C1 of the heat roller 121 and at an interval from each other.

If not receiving light from the light source 161, the light receiving section 162 outputs a detection signal. Note that the light receiving section 162 may output the detection signal if receiving the light from the light source 161.

The light blocking plate 163 is attached to the main body section 152 (the upper frame 157) or the pressurizing arm 153 via a coupling plate 165.

If the pressing unit 122 is present in the pressing position P1 shown in FIG. 8, the light blocking plate 163 is present in a position where the light blocking plate 163 does not block light traveling from the light source 161 toward the light receiving section 162. If the pressing unit 122 is present in the release position P2 shown in FIG. 9, the light blocking plate 163 is present in a position where the light blocking plate 163 blocks the light traveling from the light source 161 toward the light receiving section 162.

If the pressing unit 122 shifts from the pressing position P1 to the release position P2, the light traveling from the light source 161 to the light receiving section 162 is blocked by the light blocking plate 163. Therefore, the light receiving section 162 outputs a detection signal.

In the detecting mechanism 142, the control section 164 can output a control signal on the basis of the detection signal from the light receiving section 162 and displays on the display 210 (see FIG. 1) an indication that the pressing unit 122 is present in the release position P2. Consequently, the user can recognize that the pressing unit 122 is present in the release position P2.

The stopping mechanism 143 includes a control section 166 to which the detection signal from the light receiving section 162 is input. The control section 166 can output a control signal on the basis of the detection signal and stop a part of the operation of the image forming apparatus 200. For example, the control signal output from the control section 166 is a signal for stopping paper feed of the plane paper (the single sheet). In the paper feeding section 18 shown in FIG. 2, the feeding of the plain paper (the single sheet) can be stopped according to the control signal. With this configuration, if the pressing unit 122 is present in the release position P2, although the stacked recording medium (the envelope, etc.) is supplied, the plain paper (the single sheet) is not supplied. Therefore, it is possible to avoid a situation in which, if the plain paper (the single sheet) is supplied to the pressing unit 122 in the release position P2, toner fixing on the sheet becomes insufficient.

If the pressing unit 122 is present in the pressing position P1, the stopping mechanism 143 may output a control signal for stopping the supply of the stacked recording medium (the envelope, etc.). Consequently, if the pressing unit 122 is present in the pressing position P1, although the plain paper (the single sheet) is supplied, the stacked recording medium (the envelope, etc.) is not supplied.

Note that a photoelectric tube may be used as the light source of the detection sensor of the release detecting mechanism. A mechanical switch may be used instead of the optical sensor.

The operation of the fixing device 120 is explained.

In the state shown in FIG. 6, the pressing unit 122 is present in the pressing position P1 and the contact convex section 149 (the contact part) of the separating arm 146 is in contact with the outer circumferential surface 148*a* of the roller holding member 145.

As shown in FIG. 7, the other end portion 146*b* (an operation section) of the separating arm 146 is turned in a direction for pressing the roller holding member 145 (the clockwise direction in FIG. 7). The separating arm 146 causes, with the contact convex section 149 set as a fulcrum, a force in a direction separating from the roller holding member 145 to act on the second turning fulcrum 155. Therefore, the pressing unit 122 turns in the second direction D2 against an urging force of the urging member 123 and shifts to the release position P2.

In the separating arm 146, the distance from the second turning fulcrum 155 to the other end portion 146*b* is long compared with the distance from the second turning fulcrum 155 to the contact convex section 149. Therefore, the separating arm 146 can cause a large force to act on the pressing unit 122 with a slight pressing force by making use of the principle of leverage. Therefore, it is possible to operate the pressing unit 122 with easy operation.

The contact convex section 149 of the separating arm 146 slides with respect to the outer circumferential surface 148*a* of the roller holding mechanism 145. As explained above, the outer circumferential surface 148*a* is smooth, has high hardness, and less easily wears. Therefore, friction between the contact convex section 149 and the outer circumferential surface 148*a* is small. Therefore, it is possible to reduce resistance at the time when the separating arm 146 slides on the outer circumferential surface 148*a*. Consequently, it is possible to reduce a force required to turn the separating arm 146. Since the outer circumferential surface 148*a* is a cylindrical surface, the center axis of which coincides with the center axis C1 of the heat roller 121, friction between the contact convex section 149 and the outer circumferential surface 148*a* is small. Therefore, it is possible to shift, with easy operation, the pressing unit 122 from the pressing position P1 to the release position P2.

If the separating arm 146 is turned in a direction separating from the roller holding member 145, the pressing unit 122 returns to the pressing position P1 shown in FIG. 6 with the urging force of the urging member 123.

In the fixing device 120, irrespective of in which of the pressing position P1 (see FIG. 6) and the release position P2 (see FIG. 7) the pressing unit 122 is present, the imaginary line L1 connecting the center of the heat roller 121 and the center of the first turning fulcrum 135 passes the pressing region 130 of the pressurizing pad 127. Therefore, it is possible to reduce displacement of the pressurizing pad 127 (a change in the distance between the heat roller 121 and the pressurizing pad 127) between the pressing position P1 and the release position P2. Therefore, even if the pressing unit 122 is present in the release position P2, a pressing force of the pressing pad 127 against the heat roller 121 does not greatly decrease.

If an image is fixed on the stacked recording medium (the envelope, etc.), if the pressing unit 122 is present in the pressing position P1 (see FIG. 6), creases easily occur in the stacked recording medium because the stacked recording medium is bent. Therefore, the pressing unit 122 is set in the release position P2 (see FIG. 7). In that case, the pressing force of the pressurizing roller 126 decreases and the bend of the recording medium decreases. Therefore, the occurrence of creases is suppressed.

With the fixing device 120, since the pressing force of the pressurizing pad 127 does not decrease even if the pressing unit 122 is present in the release position P2, the pressurizing belt 125 rotates following the heat roller 121. Therefore, the conveyance of the recording medium (the stacked recording medium) such as the sheet is not hindered.

Since the fixing device 120 includes the moving mechanism 141, as explained above, it is possible to shift, with easy operation, the pressing unit 122 from the pressing position P1 to the release position P2.

Since the roller holding member 145 is the ball bearing, it is possible to reduce resistance at the time when the separating arm 146 slides on the outer circumferential surface 148*a* of the roller holding member 145.

Since the outer circumferential surface 148*a* of the roller holding member 145 is the cylindrical surface, the center axis of which coincides with the center axis C1 of the heat roller 121, it is possible to reduce resistance at the time when the separating arm 146 slides.

Since the fixing device 120 includes the detecting mechanism 142, the user can recognize that the pressing unit 122 is present in the release position P2. Therefore, it is possible to prevent the plain paper (the single sheet) from being inadvertently supplied to the pressing unit 122 present in the release position P2. Therefore, a problem such as adhesion of stain in the device due to the sheet with insufficient toner fixing less easily occurs.

Since the fixing device 120 includes the stopping mechanism 143, if the pressing unit 122 is present in the release position P2, it is possible to stop a part of the operation of the image forming apparatus 200. For example, in the paper feeding section 18 (see FIG. 2), it is possible to stop the paper feed of the plain paper (the single sheet). Therefore, it is possible to prevent the problem of the insufficient toner fixing.

Since the detection sensor 160 is an optical type (optical detection sensor), malfunction less easily occurs compared with sensors of other types. Therefore, it is possible to accurately detect that the pressing unit 122 shifts to the release position P2.

Since the urging member 123 is the coil spring, it is possible to cause a sufficient force to act on the pressurizing arm 153 with the elasticity of the coil spring. Therefore, it is possible to improve operation performance of the pressing unit 122.

As shown in FIGS. 6 and 7, the lower frame 158 of the supporting frame 151 may be capable of turning with respect to the upper frame 157 in a third turning fulcrum 170. A center axis C6 of the third turning fulcrum 170 is parallel to the center axis C1 of the heat roller 121.

With this configuration, the pressurizing belt heat roller 128 is movable, according to the turning of the lower frame 158 around the third turning fulcrum 170, in directions in which the pressurizing belt heat roller 128 approaches and separates from the pressurizing roller 126. Consequently, it is possible to easily adjust the tension of the pressurizing belt 125.

In the fixing device 20 in the embodiment, the separating arm 146 may be configured as explained below. In FIG. 7, an imaginary line connecting the center axis C5 of the second turning fulcrum 155 and the center line C1 of the heat roller 121 is assumed. The separating arm 146 may be formed such that the contact convex section 149 is located further forward than the imaginary line if the separating arm 146 is greatly turned clockwise in FIG. 7. Consequently, since the urging force of the urging member 123 acts to maintain a turning posture of the separating arm 146, even if the user releases the pressing against the separating arm 146, the separating arm 146 maintains the posture of the separating arm 146. Therefore, even if the user releases the hand from the separating arm 146, it is possible to maintain the release position P2 of the pressing unit 122.

In the fixing device in the embodiment, a tension roller may be provided in addition to the pressurizing roller, the pressurizing pad, and the pressurizing belt heat roller.

In the fixing device 120, the separating arm 146 is manually operated. However, the fixing device in the embodiment may include a mechanism for turning the separating arm. In that case, it is possible to configure the fixing device to enable the user to input, in the control panel 220, whether a recording medium to be handled is the plain paper (the single sheet) or the stacked recording medium. In the fixing device having this configuration, the separating arm is operated by the mechanism on the basis of input content. The pressing unit is set in one of the pressing position and the release position.

In the embodiment, the pressurizing belt heat roller is adopted as the belt supporting member. However, the belt supporting member is not limited to a roller and may be a non-rotating body.

According to the at least one embodiment explained above, irrespective of in which of the pressing position P1 (see FIG. 3) and the release position P2 (see FIG. 4) the pressing unit 22 is present, the imaginary line L1 connecting the center of the heat roller 21 and the center of the turning fulcrum 35 passes the pressing region 30 of the pressurizing pad 27. Therefore, the displacement of the pressurizing pad 27 decreases between the pressing position P1 and the release position P2. Consequently, even if the pressing unit 22 is present in the release position P2, the pressing force of the pressurizing pad 27 against the heat roller 21 does not greatly decrease. Therefore, the pressurizing belt 25 rotates following the heat roller 21. Consequently, the conveyance of the recording medium (the stacked recording medium) such as the sheet is not hindered.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fixing device comprising:

a first rotating body heated by a heat source;

a pressing unit comprising a belt opposed to an outer circumferential surface of the first rotating body, a second rotating body around an outer circumference surface of which the belt is wound, a belt supporting member around an outer circumferential surface of which the belt is wound, and a pushing member comprising a pressing region for pressing the belt toward the first rotating body, the pushing member disposed between the second rotating body and the belt supporting member;

the pressing unit configured to switch a pressing position in which the pressing unit turns around a turning fulcrum present in a position away from the first rotating body to thereby press the belt against the first rotating body with the second rotating body and a release position in which the pressing unit releases the pressing by the second rotating body;

when viewed from an axial direction of the first rotating body, a straight line connects a center of the first rotating body and a center of the turning fulcrum passing the pressing region of the pushing member in both of the pressing position and the release position;

an urging member configured to urge the pressing unit in a first direction in which the second rotating body approaches the first rotating body; and a moving mechanism comprising a first rotating-body holding member attached to the first rotating body and a separating arm turnably supported by the pressing unit, the moving mechanism configured to come into contact with an outer circumferential surface of the first rotating-body holding member in a contact part, the moving mechanism turning the separating arm in a direction for pressing the first rotating-body holding member to thereby move the pressing unit in a second direction opposite to the first direction with the contact part set as a fulcrum.

2. The device according to claim 1, wherein the first rotating-body holding member is a ball bearing.

3. The device according to claim 1, wherein the outer circumferential surface of the first rotating-body holding member is a cylindrical surface, a center axis of which coincides with a center axis of the first rotating body.

4. The device according to claim 1, further comprising:

a detecting mechanism configured to detect a presence of the pressing unit in the release position.

5. The device according to claim 4, further comprising:

a stopping mechanism configured to output a signal for stopping paper feeding of plain paper if the pressing unit is present in the release position.

6. The device according to claim 4, wherein the detecting mechanism is an optical detection sensor.

7. The device according to claim 1, wherein the belt supporting member is movable in directions in which the belt supporting member approaches towards and separates from the second rotating body.

8. An image forming apparatus comprising:

an image forming section configured to form a toner image comprising toner on a sheet; and the fixing device according to claim 1.

9. The image forming apparatus according to claim 8, further comprising:

a moving mechanism comprising a first rotating-body holding member attached to the first rotating body and a separating arm turnably supported by the pressing unit, the moving mechanism configured to come into contact with an outer circumferential surface of the first rotating-body holding member in a contact part, the moving mechanism turning the separating arm in a direction for pressing the first rotating-body holding member to thereby move the pressing unit in a second direction opposite to the first direction with the contact part set as a fulcrum.

10. The image forming apparatus according to claim 9, wherein the first rotating-body holding member is a ball bearing.

11. The image forming apparatus according to claim 9, wherein the outer circumferential surface of the first rotating-body holding member is a cylindrical surface, a center axis of which coincides with a center axis of the first rotating body.

12. The image forming apparatus according to claim 8, further comprising:

a detecting mechanism configured to detect a presence of the pressing unit in the release position.

13. A fixing device comprising:

a first rotating body heated by a heat source;

a pressing unit comprising a belt opposed to an outer circumferential surface of the first rotating body, a second rotating body around an outer circumference surface of which the belt is wound, a belt supporting member around an outer circumferential surface of which the belt is wound, and a pushing member comprising a pressing region for pressing the belt toward the first rotating body, the pushing member disposed between the second rotating body and the belt supporting member;

the pressing unit configured to switch a pressing position in which the pressing unit turns around a turning fulcrum present in a position away from the first rotating body to thereby press the belt against the first rotating body with the second rotating body and a release position in which the pressing unit releases the pressing by the second rotating body; and when viewed from an axial direction of the first rotating body, a straight line connects a center of the first rotating body and a center of the turning fulcrum passing the pressing region of the pushing member in both of the pressing position and the release position, wherein the urging member is a coil spring.

14. A fixing method comprising:

heating a first rotating body;

pressing a belt toward the first rotating body, a pressing unit comprising the belt, a second rotating body around an outer circumference surface of which the belt is wound, a belt supporting member around an outer circumferential surface of which the belt is wound, and a pushing member comprising a pressing region for pressing the belt toward the first rotating body, the pushing member disposed between the second rotating body and the belt supporting member;

switching a pressing position in which the pressing unit turns around a turning fulcrum present in a position away from the first rotating body to thereby press the belt against the first rotating body with the second rotating body and a release position in which the pressing unit releases the pressing by the second rotating body;

aligning a center of the first rotating body and a center of the turning fulcrum passing the pressing region of the pushing member in both of the pressing position and the release position when viewed from an axial direction of the first rotating body;

urging the pressing unit in a first direction in which the second rotating body approaches the first rotating body; and contacting a moving mechanism comprising a first rotating-body holding member attached to the first rotating body and a separating arm turnably supported by the pressing unit with an outer circumferential surface of the first rotating-body holding member in a contact part, the moving mechanism turning the separating arm in a direction for pressing the first rotating-body holding member to thereby move the pressing unit in a second direction opposite to the first direction with the contact part set as a fulcrum.

15. The method according to claim 14, wherein the outer circumferential surface of the first rotating-body holding member is a cylindrical surface, a center axis of which coincides with a center axis of the first rotating body.

16. The method according to claim 14, further comprising:

detecting a presence of the pressing unit in the release position.

17. The method according to claim 16, further comprising:

outputting a signal for stopping paper feeding of plain paper if the pressing unit is present in the release position.

18. The method according to claim 14, further comprising:

moving the belt supporting member in directions approaching towards and separating from the second rotating body.

* * * * *